United States Patent [19]

Slusser

[11] Patent Number: 4,942,896

[45] Date of Patent: Jul. 24, 1990

[54] VALVE ASSEMBLY FOR SHOWERS

[75] Inventor: J. Michael Slusser, Arlington, Tex.

[73] Assignee: Production Diagnostics, Inc.

[21] Appl. No.: 336,260

[22] Filed: Apr. 11, 1989

[51] Int. Cl.[5] ..... F16L 5/00

[52] U.S. Cl. ..... 137/360; 137/606; 4/192

[58] Field of Search ..... 4/191, 192; 137/359, 137/360, 606, 357

[56] References Cited

U.S. PATENT DOCUMENTS

| | | | |
|---|---|---|---|
| 3,215,158 | 11/1965 | Bass, Jr. et al. | 137/315 |
| 3,576,277 | 4/1971 | Blackmon | 137/606 |
| 3,862,433 | 1/1975 | Rovsselet | 137/360 |
| 4,429,422 | 2/1984 | Wareham | 4/192 |
| 4,654,900 | 4/1987 | McGhee | 4/191 |

*Primary Examiner*—A. Michael Chambers

*Attorney, Agent, or Firm*—Richards, Medlock & Andrews

[57] ABSTRACT

A valve assembly particularly designed for the control of hot and cold water comprising a frame having mounted thereon a first and second inlet conduit, and a first and second outlet conduit. A first solenoid valve connecting said first inlet and first outlet conduits to provide opening and closing of the passageways formed by those conduits. A second solenoid valve connecting said second inlet and second outlet conduits to provide for opening and closing of the passageway formed by said conduits. A ground fault circuit interrupter mounted on said frame and operatively connected to said first and second solenoid valves to prevent any potential electrical shock. The ground fault circuit interrupter is wired between the solenoids and the switched power supply providing for activation and deactivation of said solenoid valves.

13 Claims, 2 Drawing Sheets

FIG. 2
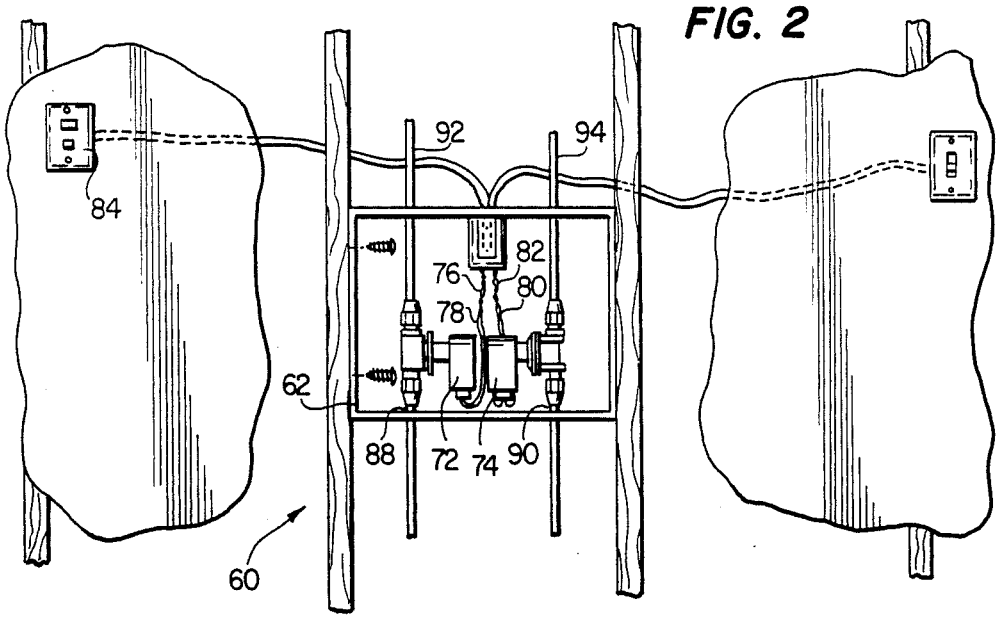
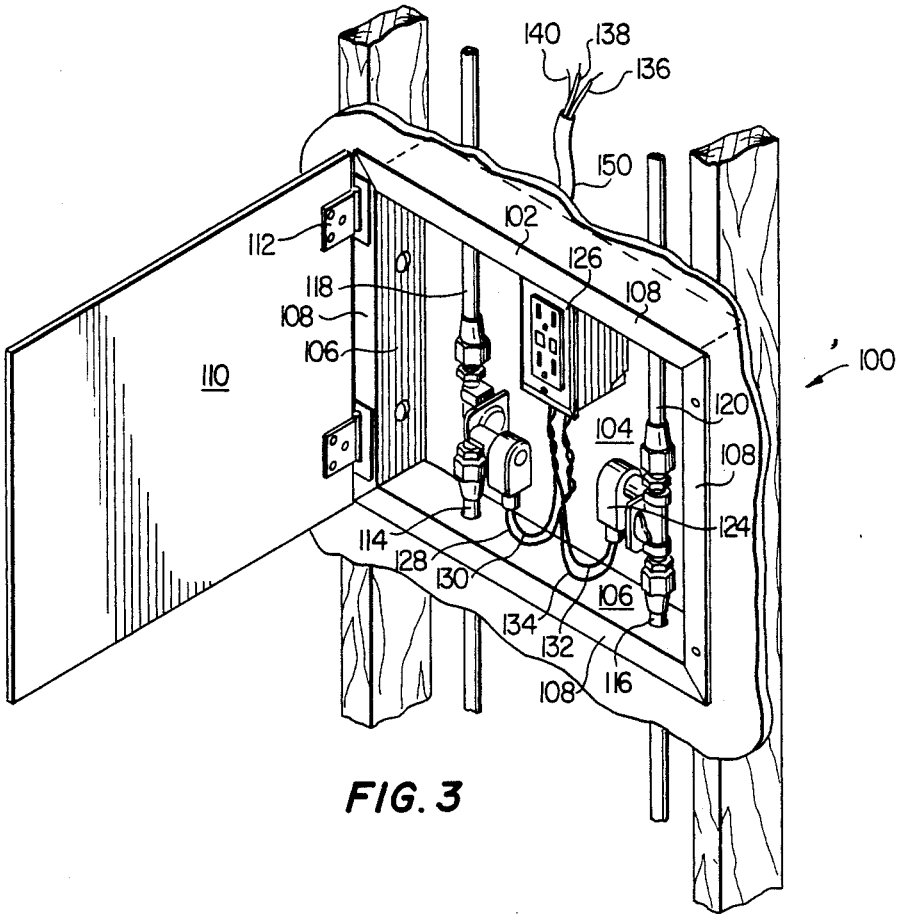
FIG. 3

VALVE ASSEMBLY FOR SHOWERS

TECHNICAL FIELD

The present invention relates to valve assemblies. In particular, the present invention relates to a valve assembly particularly useful for the operation of bathing facilities and hair salon washing stations.

BACKGROUND ART

In certain applications it is desirable to provide a valve control of both hot and cold water to provide the proper flow of water at the desired temperature. This is especially the case for repeated showers, hair washings, and similar occasions. The present invention provides a valve assembly which is suitable for use in the home, institutions and businesses to provide control of water flow and which is useful in repeatedly achieving the desired water temperature from a mixture of hot and cold water.

The assembly of the present invention is constructed such that an integral valve assembly is provided which is easy to install in homes, businesses and institutions.

SUMMARY OF THE INVENTION

In one aspect the invention provides a valve assembly comprising a frame which supports first and second inlet conduits and first and second outlet conduits. Interposed between the first inlet conduit and the first outlet conduit is first solenoid valve and interposed between the second inlet conduit and second outlet conduit is a second solenoid valve. The solenoid valves function to open and close the flow passageway formed by the inlet and outlet conduits.

In another aspect, the present invention provides a valve assembly having a frame, first nd second inlet conduits mounted on said frame, and first and second outlet conduits mounted on said frame. Interposed between the first inlet conduit and first outlet conduit is first solenoid valve and interposed between second inlet conduit and the second outlet conduit is second solenoid valve. Also supported on the frame is a ground fault circuit interrupter which is connected to said first and second solenoid valves and is provided with leads for connection to a normal switched electrical source.

In another aspect, the present invention provides a valve assembly having a frame on which is mounted a first inlet conduit, a second inlet conduit, a first outlet conduit, and a second outlet conduit. Interposed between said first inlet conduit and said first outlet conduit and connecting the flow path formed by said conduits is first solenoid valve. Interposed between the second inlet conduit and the second outlet conduit and forming a flow path with said conduits is second solenoid valve. Supported on the frame is a ground fault circuit interrupter which is connected to said first and second solenoid valves and is provided with suitable leads for connection to a switched electrical 120 volt circuit. The frame also is provided a door hingedly attached to said frame to provide access to the valve assembly.

BRIEF DESCRIPTION OF THE DRAWINGS

The drawings are to assist in understanding the detailed description of the invention and are not to be construed as limiting or illustrating the only possible embodiments of the present invention.

FIG. 2 is a front view of another embodiment of the invention mounted in place; and FIG. 3 is a perspective view of a third embodiment of the invention which provides for an access door.

DETAILED DESCRIPTION

Figure 1:
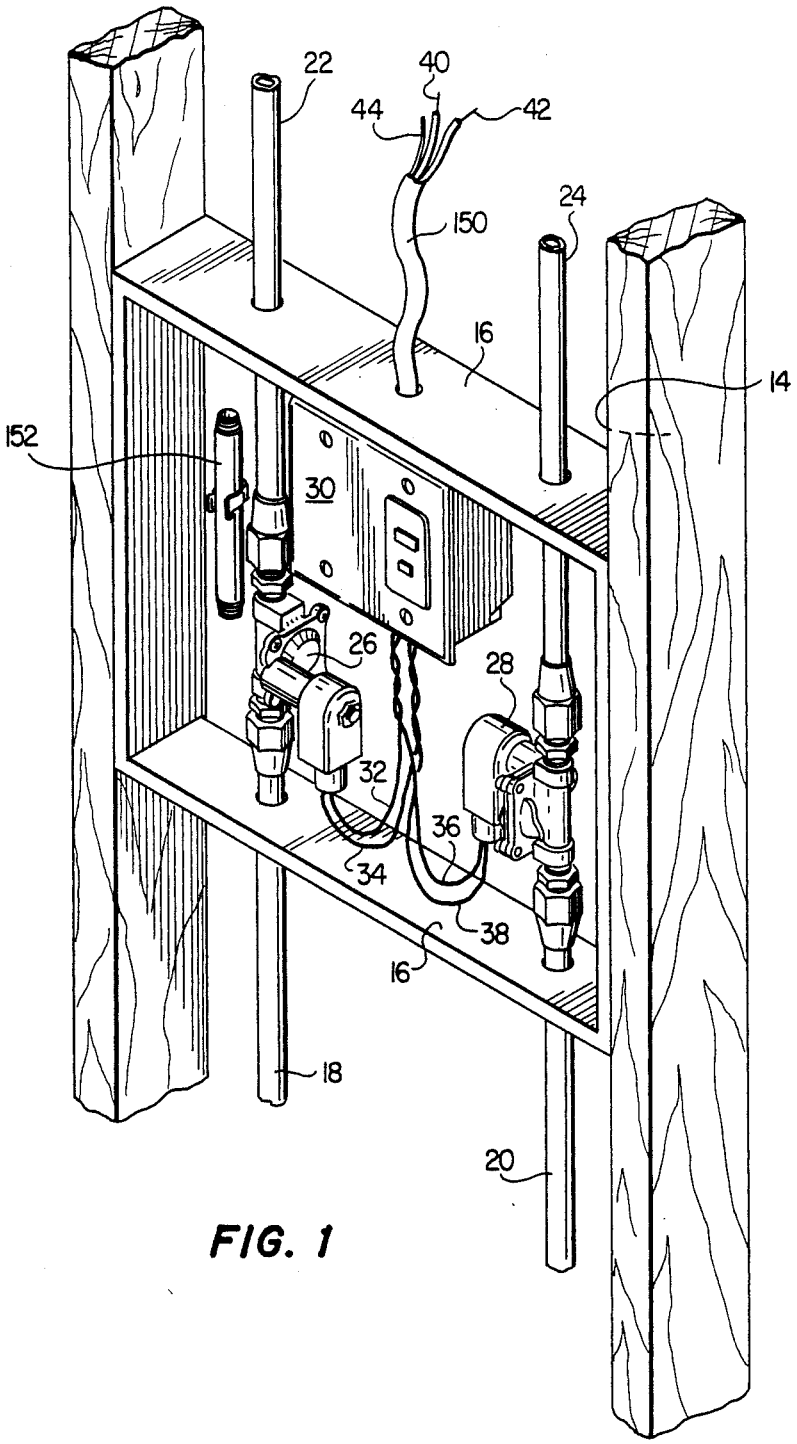
FIG. 1 is a perspective view of one embodiment of the present invention.

FIG. 1 shows the valve assembly generally indicated as 10. The valve assembly has a frame 12 and as illustrated a back 14 and four sidewalls 16 extending perpendicularly from the back. The frame can take any number of shapes, generally a rectangular box-shape is preferred. The frame, of course, can be made simply from four walls without a back, as lo::g as they serve to support the components of the valve assembly. Passing through one wall 16 is a first inlet conduit 18 and a second inlet conduit 20. Passing through one wall 16 of the frame 12 is a first outlet conduit 22 and second outlet conduit 24. The inlet and outlet conduits may be rigidly mounted on the frame or may be movably mounted on the frame such as by sliding frictional fit. It is desirable that the conduits be firmly held by the frame to prevent shifting of components, however, the ability to make slight adjustments can be an aid in manufacturing and in installation.

Interposed between said first inlet conduit 18 and said first outlet conduit 22 is first solenoid valve 26. Interposed between the second inlet conduit 20 and the second outlet conduit 24 is second solenoid valve 28. When in place the solenoid valves provide a flow path from the inlet conduits to the outlet conduits, and the valves are in the closed position, preventing flow through the outlet conduits where power is turned off. In the energized position, the solenoid valves open thereby opening the flow path and allow flow from inlet conduits through the outlet conduits. The present invention provides a means for allowing repair and replacement of defective or malfunctioning solenoid valves while maintaining normal use of bathing or salon facilities. A replacement conduit 152 may be provided which can be inserted or installed easily in place of the solenoid valves such that one can retain normal shower use while having the defective or malfunctioning solenoid valve repaired or replaced. In the preferred embodiment, the first and second solenoid valves 26 and 28 are connected to a ground fault circuit interrupter 30 by wires 32, 34, 36 and 38. The ground fault circuit interrupter 30 is provided with leads 40, 42 and 44 for connection to a switched power source such as a typical 120 volt circuit. These three leads, from the ground fault circuit interrupter 30, are the: connected to the ground, the neutral, and the hot wire of the 120 volt circuit. The circuit is provided with a switch for energizing the solenoid valves and for cutting power to the solenoid valves. If desired, the circuit connected to the valve can be wired so as to provide two or more switches to allow operation of the valve assembly from more than one location.

The frame can be constructed of any suitable material and preferably the material is nonconducting. Materials of construction include word, metal, and plastics. The conduits may be constructed of any suitable material and preferably are constructed of copper pipe of ½" diameter, which is the normal diameter found in most residential and light commercial applications. However, other diameters are suitable such as ⅛ to 2". The conduits can be of plastic material, however, care should be taken that any plastic material utilized for a conduit in which hot water will flow should be of a material resistant to the hot water, which is normally provided by most heating systems at from about 150° F. to about 190° F. The conduits and fittings should be able to withstand water hammer.

The solenoid valves are of any suitable material of construction for these applications. Preferably at least one of the valves is capable of withstanding prolonged contact with fluids at temperatures from 150° to 190° F. Both valves may be of such construction that they are resistant to elevated temperatures. Using one valve resistant to hot water is desirable for economic reasons since in the normal application it is envisioned that one inlet of the valve assembly will be connected to a cold water source and that the other inlet conduit of the valve assembly will be connected to a hot water source. Two high temperature resistant solenoid valves may be used and, while more costly, this construction offers the convenience that to whichever inlet conduit the hot water supply is connected, the solenoid valve attached to that conduit will be of a construction which is resistant to hot water. Thus, this prevents possible premature failure resulting from the hot water line being controlled by a solenoid valve not designed to be resistant to the elevated temperatures. Solenoid valves useful in the present invention are available from a number of suppliers such as but not limited to Skinner valves, Eaton solenoid valves, Richddel solenoid valves, Automatic Switch Company valves, Toro and Hunter.

The solenoid valves are connected to the inlet and outlet conduits in any suitable manner. Preferably, for ease of construction and repair, the valves are joined to copper conduits by the use of flare fittings. It is also possible to provide threaded union fittings or to solder the valves in place. In the case where the conduits are plastic, it is also possible to glue the valves in place with suitable adhesives.

FIG. 2 illustrates another embodiment of the invention mounted to a structure. FIG. 2 shows a valve assembly generally indicated by 60. The valve assembly 60 has a frame seen in the edge view as 62. The frame 62 is again constructed of four walls and has a first inlet conduit 88 and second inlet conduit 90 mounted on the frame passing through one wall and a first outlet conduit 92 and second outlet conduit 94 mounted on frame 62 passing through another wall. Interposed between the first inlet conduit 88 and the first outlet conduit 92 is a first solenoid valve 72. Connecting the second inlet conduit 9) and the second outlet conduit 94 is second solenoid valve 74. Electrical leads 76 and 78 run from the first solenoid valve 72 and electrical leads 80 and 82 lead from second solenoid valve 74. These leads are then connected to a ground fault circuit interrupter 84. In the illustrated embodiment, the ground fault circuit interrupter 84 is not part of the valve assembly 60 but is rather mounted apart from the valve assembly 60. The ground fault interrupter 84 is then connected to a normal power source and provided with a switch or switches to activate and deactivate the solenoid valves 72 and 74. Preferably, the frame 62 of the present invention is rectangular and has a width of about 14 inches which will make it readily mountable between the studs set at the normal spacing for most construction or can be dimensioned to be received between flooring joists or ceiling rafters. The first inlet conduit 88 acts as a cold water supply and the second inlet conduit 90 acts as a hot water supply. The outlet conduits 92 and 94 preferably lead to normal manual adjustable valves and then lead to the outlet which can be a shower head, faucet, hair washing attachment, etc.

In the initial operation of the valve assemblies of the present invention after they are installed, the switch is turned on thereby activating the solenoid valves, opening them permitting flow t!:rough the valve assembly in both flow passages formed by the conduits. This will normally be the flow of cold water in one conduit and flow of hot water in the other conduit. The flow will then proceed through the outlet conduits and to manual control valves which provide adjustable control of the flow. The user then adjusts the manual valves to provide the desired temperature. When they wish to turn off the flow of water, they merely turn off the electrical switch closing the solenoid valves thereby stopping the flow of water and leaving the adjustable valve set in the desired positions. Thereafter, merely switching on the solenoid valves will result in water flowing, which will shortly be at desired temperature. In household use, for example, the valve assembly of the present invention is interposed prior to the manual valves controlling a shower. Thus, the homeowner may turn on the electrical switch activating the solenoid valves thereby turning on the shower. He is not subjected to reaching into the shower to turn the valves and being subjected to too hot or too cold of water and after a short period of time they simply step into the shower at a temperature already at their desired temperature. Once the shower is completed, he simply exits the shower and turns off the electrical switch closing the solenoid valves. In hair salon applications, the present invention is very useful because merely flipping the switch will have the water delivered at the desired temperature without repeated steps of turning on and off the manual valves and adjusting them to the appropriate temperature. Rather, the operator merely turns on the switch, activating the solenoid valves, waits a short period of time and then can make minor adjustments if necessary with the manual valves. In another contemplated application, the present invention is particularly useful in institutions and public facilities. For example, in a gym situation a coach can designate a certain amount of time for showers, such as ten minutes, and after the allotted time shut down all showers at the same time by simply turning off the switch, thereby preventing flow to the shower room. Similar applications would be useful for military living quarters, jails, and etc. The present invention is also useful in institutions, such as hospitals, for the above reasons and additionally for safety reasons in that a nurse or a doctor can immediately shut off water to a shower in the event that a patient would fall or become injured in a shower. In a preferred embodiment, the valve assembly is mounted in an area which is not exposed to freezing temperatures.

FIG. 3 shows yet another embodiment of the invention, where the valve assembly generally indicated as 100, the valve assembly is made up of a frame 102 having a back 104 and four sides 106, extending perpendicularly from the back 104. In the preferred embodiment, the frame assembly results in a rectangular box-like form, however, other forms ray be utilized. In a preferred embodiment, the back 104 is about 12 inches × 14 inches so that the frame is readily positionable between the typical stud construction utilized in homes and offices. Extending substantially perpendicular to the sidewalls 106, in an outward direction, are flanges 108 resulting in surfaces that are in a plane approximately parallel to back 104. In the preferred embodiment, sidewalls 106 extend about 2 to 3.5 inches from said back 104, again so that the valve assembly may be fitted between studs found in normal construction. Hingedly attached to the frame 102 is door 110 which is preferably hingedly connected with hinges 112 to the frame 102. As illustrated, the door is attached to flange 10B, however, it is recognized that flange 108 is not necessary and that the hinge 112 may be attached to the frame 102 at other locations. The valve assembly has a first inlet conduit 114 and a second inlet conduit 116 mounted on and extending from the frame as are first outlet conduit 118 and second outlet conduit 120. As described above, the inlet and outlet conduits are mounted on the frame in any desired manner. Preferably, they are firmly held by the frame, but may be mounted such that slight variations in their positioning is allowed. Interposed and connecting inlet conduit 114 with the first outlet conduit 118 is a first solenoid valve 122. Interconnected between second inlet conduit 116 and second outlet conduit 120 is second solenoid valve 124. These valves are connected to ground fault circuit interrupter 126 by electrical leads 128, 130 for solenoid valve 122 and leads 132 and 134 for the second solenoid valve 124. Extending from around fault circuit interrupter 126 are leads 136, 138 and 140 for connection of the ground fault circuit interrupter to a suitable switched electrical power source such as a 120 volt circuit. Three leads are provided such that they may be connected to the neutral, hot and ground wires of the typical 120 volt circuit. In the preferred embodiment, passageway 142 is provided in the frame to allow passage of the switched electrical power source lead 150 from outside of the frame assembly to inside the frame assembly. The solenoid valves can be connected to the inlet and outlet conduits as described above and similar materials of construction may be used in this embodiment as described above.

While the invention has been described in relation to preferred embodiments described herein, it is understood that the invention is not limited to the particular embodiments illustrated.

What is claimed:

1. A valve assembly for control of water comprising:
(a) a frame;
(b) a first inlet conduit mounted on said frame;
(c) a second inlet conduit mounted on said frame;
(d) a first outlet conduit mounted on said frame;
(e) a second outlet conduit mounted on said frame;
(f) a first solenoid valve conducting said first inlet conduit with said first outlet conduit to provide opening and closing of the first passageway formed by said conduit; and
(g) a second solenoid valve connecting said second inlet conduit to said second outlet conduit to provide for opening and closing the second passageway formed by saId second conduit thereby controlling flow of fluid therethrough.

2. The valve assembly of claim 1, further comprising a ground fault interrupter circuit mounted on said frame and operatively connected to said first and second solenoid valves.

3. The valve assembly of claim 1, wherein at least one of said solenoid valves is constructed of materials which withstand temperatures in the range of 150°–190° F. for prolonged periods.

4. The valve assembly of claim 2, wherein at least one of said solenoid valves is constructed of materials which withstand temperatures in the range of 150° 190° F. for prolonged periods.

5. The valve assembly of claim 1, further comprising a replacement conduit removably mounted on said frame.

6. A valve assembly comprising:
(a) a frame;
(b) a first inlet conduit mounted on said frame;
(c) a second inlet conduit mounted on said frame;
(d) a first outlet conduit mounted on said frame;
(e) a second outlet conduit mounted on said frame;
(f) a first solenoid valve connecting said first inlet conduit with said first outlet conduit to provide opening and closing of the first passageway formed by said conduit;
(g) a second solenoid valve connecting said second inlet conduit to said second outlet conduit to provide for opening and closing the second passageway formed by saId second conduit thereby controlling flow of fluid therethrough; and
(h) a ground fault circuit interrupter mounted on said frame and operatively connected with both first and second solenoid valves.

7. The valve assembly of claim 6, wherein at least one of said solenoid valves is constructed of materials which withstand temperatures in the range of 150°–190° F.

8. The valve assembly of claim 6, wherein both first and second solenoid valves are constructed of materials which withstand temperatures in the range of 150°–190° F.

9. The valve assembly of claim 6, further comprising a replacement conduit removably mounted on said frame.

10. A valve assembly comprising:
(a) a frame having
(i) a back,
(ii) four walls extending from said back in substantially perpendicular direction to form a receptacle to accommodate valve components,
(iii) a cover mounted on one of said walls to provide an enclosure for valve components and to allow access to said valve components;
(b) an inlet conduit mounted on said frame extending through one wall of said frame and into the interior of said frame;
(c) a second inlet conduit mounted on said frame and extending through a wall of said frame into the interior of said frame;
(d) an outlet conduit mounted on said frame and extending through one wall of said frame into the interior of said frame;
(e) a second outlet conduit mounted on said frame and extending through a wall of said frame into the interior of said frame;
(f) a first solenoid valve connecting said first inlet conduit with said first outlet conduit to provide for opening and closing of the passageway formed by said first conduits;
(g) a second solenoid valve connecting said second inlet conduit and said second outlet conduit to provide for opening and closing of the passageway formed by said second conduits; and
(h) a ground fault mounted on one wall of said frame and operatively connected to both solenoid valves.

11. The valve assembly of claim 10, wherein at least one of said solenoid valves is constructed of material to withstand a temperature of 150°–190° F.

12. The valve assembly of claim 10, wherein both of said solenoid valves are constructed of materials which withstand temperatures in the range of 150°–190° F. for prolonged periods.

13. The valve assembly of claim 10, further comprising a replacement conduit removably mounted on said frame.

* * * * *

UNITED STATES PATENT AND TRADEMARK OFFICE

CERTIFICATE OF CORRECTION

PATENT NO. : 4,942,896

DATED : July 24, 1990

INVENTOR(S) : J. Michael Slusser

It is certified that error appears in the above-identified patent and that said Letters Patent is hereby corrected as shown below:

Column 1, line 37, delete "nd" and insert therefore --and--.

Column 2, line 15, delete "lo::g" and insert therefore --long--.

Column 2, line 52, delete "the:" and insert therefore --then--.

Column 3, line 29, delete "Richddel" and insert therefore --Richdel--.

Column 3, line 50, delete "9)" and insert therefore --90--.

Column 4, line 62, delete "ray" and insert therefore --may--.

Column 5, line 7, delete "10B" and insert therefore --108--.

Column 5, line 24, delete "around" and insert therefore --ground--.

Column 5, line 49, delete "conducting" and insert therefore --connecting--.

UNITED STATES PATENT AND TRADEMARK OFFICE
CERTIFICATE OF CORRECTION

ATENT NO. : 4,942,896

ATED : July 24, 1990

NVENTOR(S) : J. Michael Slusser

It is certified that error appears in the above-identified patent and that said Letters Patent is hereby orrected as shown below:

Column 5, line 67, delete "150° 190°F" and insert therefore --150°-190°F--.

Signed and Sealed this

Twelfth Day of November, 1991

*Attest:*

HARRY F. MANBECK, JR.

*Attesting Officer*

*Commissioner of Patents and Trademarks*